United States Patent [19]

Bertani, Alberto et al.

[11] Patent Number: 4,552,034

[45] Date of Patent: Nov. 12, 1985

[54] TIPPING HANDLE FOR CONTROL HANDWHEELS

[75] Inventors: Bertani, Alberto, Milan; Piercarlo Mariani; Davide Lissoni, both of Monza, all of Italy

[73] Assignee: Elesa S.p.A., Milan, Italy

[21] Appl. No.: 464,714

[22] Filed: Feb. 7, 1983

[30] Foreign Application Priority Data

Feb. 12, 1982 [IT] Italy ..... 19644 A/82

[51] Int. Cl.[4] ..... G05G 1/10

[52] U.S. Cl. ..... 74/547; 74/551.3; 403/111; 403/120

[58] Field of Search ..... 74/547, 524, 551.3, 74/555, 529, 528; 403/111, 120, 121

[56] References Cited

U.S. PATENT DOCUMENTS

| | | | |
|---|---|---|---|
| 2,346,615 | 4/1944 | Santon | 74/547 |
| 2,913,195 | 11/1959 | Phillips | 74/547 |
| 3,464,289 | 9/1969 | Urbach | 74/547 |
| 3,857,300 | 12/1974 | O'Dell et al. | 74/547 |
| 4,281,526 | 8/1981 | Lipschutz | 74/524 |

FOREIGN PATENT DOCUMENTS

| | | | |
|---|---|---|---|
| 66068 | 4/1982 | Japan | 74/524 |
| 848123 | 9/1960 | United Kingdom | 74/547 |

*Primary Examiner*—Gary L. Smith
*Assistant Examiner*—Michael F. Trettel
*Attorney, Agent, or Firm*—Robbins & Laramie

[57] ABSTRACT

A tipping safety handle with automatic release for handwheels or the like designed for use on machine tools, can be engaged by axial displacement inside the handwheel body. For this purpose, the handle comprises pin clutch means acting between the handle and said body, which means preferably comprise a clutch pin and a release counter-pin, both opposed by return springs.

3 Claims, 4 Drawing Figures

TIPPING HANDLE FOR CONTROL HANDWHEELS

BACKGROUND OF THE INVENTION

The present invention relates to a tipping safety handle with automatic release for handwheels or other control members in general, such as used for example for carrying out operations of adjustment, setting and feeding or the like, in machine tools or in other machines and apparatuses.

As known, the presence of a handle makes the use of said control members, and particularly of handwheels, more simple and precise, especially when the operation covers a wide range or requires a certain effort, but it is also known, on the other hand, that said presence has the drawback of constituting—due to the fact that the handle projects towards the operator—a dangerous obstacle when the machine performs movements which are not directly controlled by the handwheel. This drawback is particularly serious in machine tools, wherein the transverses can be either controlled by a manually operated slow feed handwheel for fine setting or adjustment, or by an automatic mechanical quick feed control for broader traverses and rough adjustments of the machine parts. The quickness of such traverses, which determines speedy rotations of the handwheels, and the fact that the traverses are automatically controlled and often involve a certain number of handwheels set on a machine, especially if the latter is of complex type, have led designers and constructors—when there has been no interference on the part of legislators—to reduce or exclude the use of handwheels with control handle in various machines. However, this has not helped to solve the problem since, as said, the use of a handle on control handwheels is often very convenient and helpful for the best performance of the operation.

SUMMARY OF THE INVENTION

These problems are now fully and satisfactorily solved by the present invention, which relates to a tipping safety handle with automatic release for handwheels and like control members, of the type apt to be engaged, by axial displacement in an operating position, on the body of the control member, and characterized in that it comprises pin clutch means acting between the handle and said body.

Preferably, the pin clutch means of the tipping safety handle according to the invention comprise a clutch pin, apt to be engaged against the action of return spring means, and a release counter-pin, spring urged against the engagement of said clutch pin.

According to a first embodiment of the invention, the pin clutch means comprise a pin mounted in the handle and apt to be axially displaced by the handle grip towards the body of the control member, in order to engage a seat thereof against the action of return spring means provided inside the handle and coaxial to the pin, and a counter-pin mounted in the body of the control member and elastically urged into said seat in opposition to said pin.

According to a second embodiment of the invention, the pin clutch means comprise a pin mounted inside the body of the control member and axially urged by spring means towards the handle, in order to engage a seat thereof, and a counter-pin mounted inside the handle and apt to be axially moved away from said body by the handle grip, against the action of return means.

BRIEF DESCRIPTION OF THE DRAWINGS

The tipping handle according to the invention will now be described in further detail, by mere way of example, with reference to two preferred embodiments thereof, illustrated in the accompanying drawings, in which.

DESCRIPTION OF THE PREFERRED EMBODIMENTS

Figures 1, 2:
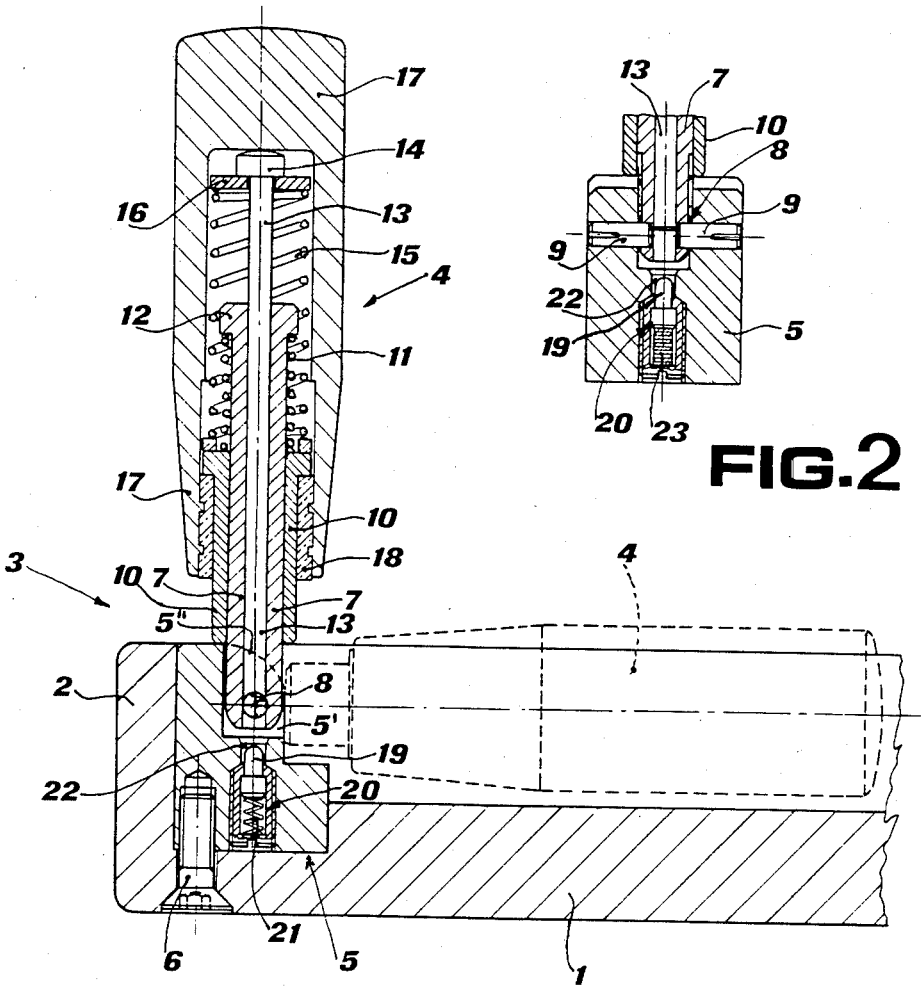
FIG. 1 is a partial, section view of a handle according to the invention, applied on a disk handwheel.
FIG. 2 shows in detail, and in a section at 90° with the previous one, the area wherein act the clutch means of the handle of FIG. 1, of which it also shows a partial modification.

FIG. 1 of the drawings shows part of the disk 1 and of the peripheral crown 2 of a conventional handwheel equipped with a control handle 3 according to the invention.

The handle 3 comprises a true and proper handle 4 and a support 5 embedded into the body of the handwheel between the disk 1 and the crown 2 and fixed therein by one or more screws 6. The true and proper handle 4 comprises in turn: a tubular core 7 pivoted at 8 to the support 5 by means of a pair of transversal pins 9 which leave free the axial through hole thereof; a bush 10 around the core 7 and slidable thereon; a spring 11 compressed between the bush 10 and a shoulder 12 of the inner end of core 7; a pin 13 with head 14, mounted slidable inside the core 7; a spring 15 compressed between the bush 10 and a washer 16, which surrounds the pin 13 close to its head 14; and a hollow handgrip 17 for the handle, applied by means of a cylindrical insert 18 sliding on the bush 10. Whereas, the support 5 comprises a slit 5', positioned radially to the handwheel and slightly wider than the diameter of the core 7, to allow the handle to oscillate between the operating position, shown in continuous lines in the drawing, and the flat rest position, shown in dashed lines, said slit being delimited by curved edges 5''. Furthermore, the support 5 incorporates a counter-pin 19, sliding in a seat 20 therefor in order to engage, under the action of a spring 21, a seat 22 of the said support being apt to receive the outer end of the pin 13. As shown in FIG. 2, the spring 21 can be replaced, according to a partial modification of the previous embodiment, by a yielding element 23 of rubber or the like. With an arrangement as that heretofore described, the handle 4 normally takes up its rest position, in the flat overturned condition shown in dashed lines in FIG. 1, substantially housed inside the handwheel cavity determined by the crown 2 in respect of the disk 1. This takes place in that the spring 11 presses the bush 10 constantly in engagement against the curved edges 5'' of the slit 5' of the support 5, the design of said edges being such as to allow expansion of the spring 11 when the handle 4 tips over. Besides, by gripping the handle 4, this latter can be shifted with no difficulty into the upright operating position, shown in continuous lines in FIG. 1. In this position, if the handgrip 17 of the handle 4 is pressed towards the handwheel, the pin 13 moves axially therewith into the hole of the core 7, reaches with its end the seat 22 of the support 5 and penetrates therein, expelling therefrom the counter-pin 19 by overcoming the action of the spring 21 or the elasticity of the rubber element 23. As long as the operator keeps the handgrip 17 pressed towards the handwheel, the handle 4 remains in full engagement with the body of the handwheel, in its operating position, i.e. totally projecting from said handwheel and substantially perpendicular to its lane (or parallel to the shaft having to be controlled), so as to allow an operation substantially identical to that of a handwheel with fixed handle. When, instead, the operator's hand abandons the handgrip 17 and thus stops pressing it towards the handwheel, the spring 11 immediately tends to rotate the handle 4 towards the overturned rest position, while the spring 15 tends to draw the pin 13 out of the seat 22, as is indispensable for the tipping over to take place. Nevertheless, the release of the handle for tipping over is guaranteed only by the presence of the counter-pin 19, which is simultaneously pressed by the spring 21 (or by the rubber element 23) against the end of the pin 13, in order to expel it from the seat 22. In fact, if the counter-pin 19 were lacking, the pin 13 could stick and cause friction in the seat 22, with the possibility of blocking the handle 4 in the upright position, or close thereto, which event must obviously be positively avoided, in view of the objects of safety proposed by the invention.

Figures 3, 4:
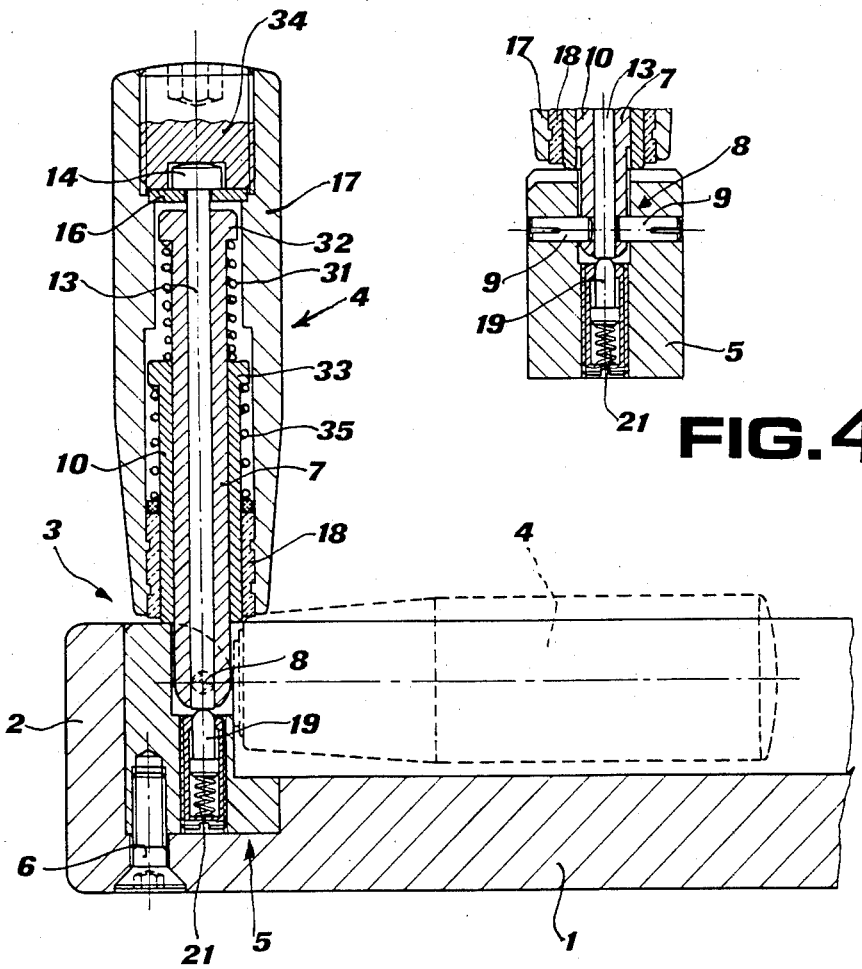
FIG. 3 is a view similar to that of FIG. 1, of a second embodiment of the handle according to the invention.
FIG. 4 is a section view, similar to that of FIG. 2, of the handle of FIG. 3.

In the embodiment of FIGS. 3 and 4, the arrangement has been modified to obtain the engagement of the handle for operation by a pulling action—instead of a pressing action, as in the previous case—onto the handgrip of the handle, thereby obtaining a still further safety for the operator than in the previous case.

For this purpose, the handle 4 and the support 5 of the handwheel, shown in these figures, comprise some modifications in the structure: the handle 4 again comprises a tubular core 7 pivoted at 8 to the support 5 by means of two transversal pins 9, and a bush 10 around the core 7 and slidable thereon, but this bush is normally pressed towards the pivoted end of the core 7 by a spring 31, compressed between a head 32 of the inner end of the core 7 and a head 33 of the corresponding end of the bush 10. A counter-pin 13 may slide within the core 7, the head 14 of said counter-pin being anchored inside the end of the hollow handgrip 17 of the handle 4 thanks to a washer 16 fixed into a seat of said handgrip closed by a screw block 34, the handgrip 17 being applied on the handle 4 by means of a cylindrical insert 18 slidable on the bush 10, at the end of the handgrip opposite to the block 34, and subject to the action of a spring 35 compressed between said insert and the head 33 of the bush 10. In turn, the support 5—whose general shape is similar to that of the support for the handle of FIG. 1, namely with a slit 5' for oscillation of the handle, delimited by curved edges 5''—incorporates a pin 19 pressed by a spring 21 towards the cavity of the handle core 7, to bear axially against the counter-pin 13.

With the arrangement shown in FIGS. 3 and 4, the handle 4 normally takes up the flat overturned position illustrated in dashed lines, substantially housed in the handwheel, the action of the spring 31 on the bush 10 being the same as that operated by the spring 11 on the bush 10 of the handle of FIG. 1. When the operator has carried the handle 4 in the operating position, drawn in continuous lines in FIG. 3, in order to obtain the engagement of said handle with the body of the handwheel, he has to operate a pulling action on the handgrip 17. This will then slide in respect of the core 7, against the action of the springs 31 and 35, and will carry therewith the counter-pin 13, thereby freeing the end close to the support 5 of the through hole of the core 7 itself. The seat being thus formed for the pin 19 immediately houses this latter, which is pressed by the spring 21, thereby establishing the required engagement between handle and handwheel in the operating position. When the operator abandons the handgrip 17, the springs 31 and 35 tend to re-establish the contact between said handgrip and the handwheel; the counter-pin 13 thus expels the pin 19 from the end of core 7 and the handle is at once free to tip over in a safety rest position, still under the action of the spring 31.

It is understood that there may be other embodiments of the safety handle and modifications of those heretofore described, without departing from the scope of the present invention.

We claim:

1. A safety handle for a handwheel which is movable between an operating position and a retracted position, comprising:

(a) an elongated handle;

(b) pivoting means for pivotally connecting one end of the handle to the handwheel, including a pin clutch means for locking said handle into said operating position when said handle is pivoted into said operating position and a sufficient force is applied along the longitudinal axis of the handle, wherein said pin clutch includes a resilient element for applying a counter-force when said longitudinally oriented force is applied to said handle, and wherein said pin clutch locks said handle into said operating position when said longitudinal force overcomes the counter-force applied by said resilient element, and wherein said counter-force unlocks said pin clutch when said longitudinal force does not overcome said counter-force, and (c) a biasing means for pivoting said handle into said retracted position when said longitudinal force is removed from said handle.

2. A safety handle for a handwheel including an outer face having an outer circumferential portion with a recess therein comprising:

a handle mounting support adapted to be secured in said recess, said support having aligned bores and a slot transverse to said bores, said slot being delimited by curved edges;

transverse pins disposed in said bores;

a handle having a tubular core, the end of which projects from said handle and is pivoted on said transverse pins of said support in order to connect said handle to said handwheel, the projecting end of said tubular core passing through said slot;

spring means in said handle for biasing said handle against the curved edges of the slot of said support into a retracted position inside the outer circumferential portion of said handwheel, and pin clutch means acting between said handle and said support for locking said handle into said support when a sufficient force is applied along the longitudinal axis of the handle.

3. A safety handle for a handwheel which is movable between an operating position and a retracted position, comprising:

(a) an elongated handle;

(b) pivoting means for pivotally connecting one end of the handle to the handwheel, including a pin clutch means for locking said handle into said operating position when said handle is pivoted into said operating position and a sufficient force is applied along the longitudinal axis of the handle, wherein said pivoting means also includes a slot having a curved edge, and (c) a biasing means for pivoting said handle into said retracted position when said longitudinal force is removed from said handle, including a spring-loaded bush which rides on the curved edge of the slot of the pivoting means.

* * * * *